US007261396B2

(12) United States Patent
Hawkins et al.

(10) Patent No.: US 7,261,396 B2
(45) Date of Patent: Aug. 28, 2007

(54) CONTINUOUS INKJET PRINTER HAVING ADJUSTABLE DROP PLACEMENT

(75) Inventors: Gilbert A. Hawkins, Mendon, NY (US); David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 289 days.

(21) Appl. No.: 10/903,047

(22) Filed: Oct. 14, 2004

(65) Prior Publication Data

US 2006/0082606 A1 Apr. 20, 2006

(51) Int. Cl.
*B41J 29/38* (2006.01)
*B41J 2/02* (2006.01)
*B41J 2/07* (2006.01)

(52) U.S. Cl. ..... 347/74; 347/73; 347/11

(58) Field of Classification Search ..... 347/74, 347/75, 78
See application file for complete search history.

(56) References Cited

U.S. PATENT DOCUMENTS

| | | | | |
|---|---|---|---|---|
| 1,941,001 | A | 12/1933 | Hansell | |
| 3,373,437 | A | 3/1968 | Sweet et al. | |
| 3,709,432 | A | 1/1973 | Robertson | |
| 4,275,401 | A | 6/1981 | Burnett et al. | |
| 4,347,521 | A | 8/1982 | Teumer | |
| 4,384,296 | A | 5/1983 | Torpey | |
| 4,533,925 | A | 8/1985 | Tsao et al. | |
| 4,540,990 | A | 9/1985 | Crean | |
| 4,613,871 | A | 9/1986 | Katerberg | |
| 4,620,196 | A | 10/1986 | Hertz et al. | |
| 4,636,808 | A | 1/1987 | Herron | |
| 4,914,522 | A | 4/1990 | Duffield et al. | |
| 4,956,648 | A | 9/1990 | Hongo | |
| 5,224,843 | A | 7/1993 | van Lintel | |
| 6,003,979 | A | 12/1999 | Schneider et al. | |
| 6,097,821 | A | 8/2000 | Yokoyama et al. | |
| 6,213,595 | B1 | 4/2001 | Anagnostopoulos et al. | |
| 6,367,909 | B1 | 4/2002 | Lean | |
| 6,450,628 | B1 * | 9/2002 | Jeanmaire et al. | 347/75 |
| 6,457,797 | B1 | 10/2002 | van Der Meijs et al. | |
| 6,478,414 | B2 * | 11/2002 | Jeanmaire | 347/77 |

(Continued)

FOREIGN PATENT DOCUMENTS

| | | |
|---|---|---|
| EP | 1 219 428 | 7/2002 |

(Continued)

*Primary Examiner*—Matthew Luu
*Assistant Examiner*—Shelby Fidler
(74) *Attorney, Agent, or Firm*—William R Zimmerli

(57) ABSTRACT

A method of printing includes associating a pixel area of a recording medium with a nozzle and a time interval during which a fluid drop ejected from the nozzle can impinge the pixel area of the recording medium; dividing the time interval into a plurality of subintervals; grouping some of the plurality of subintervals into blocks; associating one of two labels with each block, the first label defining a printing drop, the second label defining non-printing drops; associating no drop forming pulse between subintervals of each block having the first label; associating a drop forming pulse between each subinterval of each block having the second label; associating a drop forming pulse between other subintervals, the drop forming pulse being between each pair of consecutive blocks; and causing drops to be ejected from the nozzle based on the associated drop forming pulses.

16 Claims, 14 Drawing Sheets

U.S. PATENT DOCUMENTS

| | | | | |
|---|---|---|---|---|
| 6,491,362 | B1 * | 12/2002 | Jeanmaire | 347/15 |
| 6,508,543 | B2 | 1/2003 | Hawkins et al. | |
| 6,517,197 | B2 * | 2/2003 | Hawkins et al. | 347/74 |
| 6,527,375 | B2 * | 3/2003 | Kobayashi et al. | 347/55 |
| 6,536,873 | B1 | 3/2003 | Lee et al. | |
| 6,554,410 | B2 * | 4/2003 | Jeanmaire et al. | 347/77 |
| 6,568,778 | B1 | 5/2003 | Sekiya et al. | |
| 6,572,222 | B2 | 6/2003 | Hawkins et al. | |
| 6,575,566 | B1 | 6/2003 | Jeanmaire et al. | |
| 6,588,888 | B2 * | 7/2003 | Jeanmaire et al. | 347/77 |
| 6,746,108 | B1 * | 6/2004 | Jeanmaire | 347/82 |
| 6,851,796 | B2 * | 2/2005 | Jeanmaire et al. | 347/74 |
| 6,863,385 | B2 * | 3/2005 | Jeanmarie et al. | 347/77 |
| 6,923,522 | B2 * | 8/2005 | Tanaka et al. | 347/41 |
| 2003/0174190 | A1 | 9/2003 | Jeanmaire | |

FOREIGN PATENT DOCUMENTS

| | | |
|---|---|---|
| EP | 1 277 578 | 1/2003 |
| EP | 1 277 582 | 1/2003 |

* cited by examiner

CONTINUOUS INKJET PRINTER HAVING ADJUSTABLE DROP PLACEMENT

CROSS REFERENCE TO RELATED APPLICATIONS

Reference is made to commonly assigned, U.S. patent application Ser. No. 10/903,051, filed Jul. 30, 2004, entitled "SUPPRESSION OF ARTIFACTS IN INKJET PRINTING, in the name of Gilbert A. Hawkins, et al., the disclosure of which is incorporated herein by reference.

FIELD OF THE INVENTION

This invention generally relates to digitally controlled printing devices and more particularly relates to a continuous ink jet printhead that integrates multiple nozzles on a single substrate and in which the breakup of a liquid ink stream into printing droplets is caused by a periodic disturbance of the liquid ink stream.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized by technology as either drop on demand ink jet or continuous ink jet.

The first technology, drop-on-demand ink jet printing, typically provides ink droplets for impact upon a recording surface using a pressurization actuator (thermal, piezoelectric, etc.). Selective activation of the actuator causes the formation and ejection of a flying ink droplet that crosses the space between the print head and the print media and strikes the print media. The formation of printed images is achieved by controlling the individual formation of ink droplets, as is required to create the desired image. With thermal actuators, a heater, located at a convenient location, heats the ink causing a quantity of ink to phase change into a gaseous steam bubble. This increases the internal ink pressure sufficiently for an ink droplet to be expelled. The bubble then collapses as the heating element cools, and capillary action draws fluid from a reservoir to replace ink that was ejected from the nozzle.

Piezoelectric actuators, such as that disclosed in U.S. Pat. No. 5,224,843, issued to vanLintel, on Jul. 6, 1993, have a piezoelectric crystal in an ink fluid channel that flexes in an applied electric field forcing an ink droplet out of a nozzle. The most commonly produced piezoelectric materials are ceramics, such as lead zirconate titanate, barium titanate, lead titanate, and lead meta-niobate.

Many other types of drop on demand actuators have been disclosed. In U.S. Pat. No. 4,914,522, which issued to Duffield et al. on Apr. 3, 1990, a drop-on-demand ink jet printer utilizes air pressure to produce a desired color density in a printed image. Ink in a reservoir travels through a conduit and forms a meniscus at an end of an ink nozzle. An air nozzle, positioned so that a stream of air flows across the meniscus at the end of the nozzle, causes the ink to be extracted from the nozzle and atomized into a fine spray. The stream of air is applied for controllable time periods at a constant pressure through a conduit to a control valve. The ink dot size on the image remains constant while the desired color density of the ink dot is varied depending on the pulse width of the air stream.

The second technology, commonly referred to as "continuous stream" or "continuous" ink jet printing, uses a pressurized ink source that produces a continuous stream of ink droplets. Conventional continuous ink jet printers utilize electrostatic charging devices that are placed close to the point where a filament of ink breaks into individual ink droplets. The ink droplets are electrically charged and then directed to an appropriate location by deflection electrodes. When no print is desired, the ink droplets are directed into an ink-capturing mechanism (often referred to as catcher, interceptor, or gutter). When print is desired, the ink droplets are directed to strike a print medium.

U.S. Pat. No. 1,941,001, issued to Hansell on Dec. 26, 1933, and U.S. Pat. No. 3,373,437 issued to Sweet et al. on Mar. 12, 1968, each disclose an array of continuous ink jet nozzles wherein ink droplets to be printed are selectively charged and deflected towards the recording medium. This early technique is known as electrostatic binary deflection continuous ink jet.

U.S. Pat. No. 4,636,808, issued to Herron et al., U.S. Pat. No. 4,620,196 issued to Hertz et al. and U.S. Pat. No. 4,613,871 disclose techniques for improving image quality in electrostatic continuous ink jet printing including printing with a variable number of drops within pixel areas on a recording medium produced by extending the length of the voltage pulses which charge drops so that many consecutive drops are charged and using non-printing or guard drops interspersed in the stream of printing drops. Additionally, U.S. Pat. No. 6,003,979, issued to Schneider et al. on Dec. 21, 1999, discloses grouping of guard drops and printing drops in droplet streams so that some groups have no guard drops interspersed between a particular number of printed drops.

Later developments for continuous flow ink jet improved both the method of drop formation and methods for drop deflection. For example, U.S. Pat. No. 3,709,432, issued to Robertson on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitude stimulations resulting in longer filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

U.S. Pat. No. 6,079,821, issued to Chwalek et al. on Jun. 27, 2000, discloses a continuous ink jet printer that uses actuation of asymmetric heaters to create individual ink droplets from a filament of working fluid and to deflect those ink droplets. A print head includes a pressurized ink source and an asymmetric heater operable to form printed ink droplets and non-printed ink droplets. Printed ink droplets flow along a printed ink droplet path ultimately striking a receiving medium, while non-printed ink droplets flow along a non-printed ink droplet path ultimately striking a catcher surface. Non-printed ink droplets are recycled or disposed of through an ink removal channel formed in the catcher.

U.S. Pat. No. 6,588,888 entitled "Continuous Ink-Jet Printing Method and Apparatus" issued to Jeanmaire et al. discloses a continuous ink jet printer capable of forming droplets of different size and with a droplet deflector system for providing a variable droplet deflection for printing and non-printing droplets.

Typically, continuous ink jet printing devices are faster than drop-on-demand devices and are preferred where higher quality printed images and graphics are needed. However, continuous ink jet printing devices can be more complex than drop-on-demand printers, since each color printed requires an individual droplet formation, deflection, and capturing system.

Briefly referring to FIG. 1*a,* a continuous ink jet printer system 10 includes an image source 50 such as a scanner or computer which provides raster image data, outline image data in the form of a page description language, or other forms of digital image data. Image data image processor 60 is stored in image memory 80 and is sent to droplet controller 90 which generates patterns of time-varying electrical pulses to cause droplets to be ejected from an array of nozzles on print head 16, as will be described. These pulses are applied at an appropriate time, and to the appropriate nozzle, so that drops formed from a continuous ink jet stream will form spots on a recording medium 18 in the appropriate position designated by the data in image memory 80.

Referring to FIG. 1*b,* a representative prior art continuous inkjet printhead 16 (U.S. Patent Application Publication No. US 2003/0202054) is shown schematically. Ink 19 is contained in an ink reservoir 28 under pressure. The ink is distributed to the back surface of print head 16 by an ink channel 30 in silicon substrate 15. The ink preferably flows through slots and/or holes etched through silicon substrate 15 of print head 16 to its front surface, where a plurality of nozzles 21 and heaters 22 are situated. In the non-printing state, continuous ink jet non-printing droplets 40 deflected by drop deflection means 48 and are unable to reach recording medium 18 due to an ink gutter 17 that blocks the non-printing droplets. Printing droplets 38, which are shown larger than non-printing droplets in FIG. 1*b,* are deflected only slightly by drop deflection means 48 and therefore miss gutter 17 and reach recording medium 18. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26, FIG. 1*a*.

One well known problem with any type of inkjet printer, whether drop-on-demand or continuous flow, relates to precision of dot positioning. As is well known in the art of inkjet printing, one or more droplets are generally desired to be placed within pixel areas (pixels) on a receiver, the pixel areas corresponding, for example, to pixels of information comprising digital images. Generally, these pixel areas comprise either a real or a hypothetical array of squares or rectangles on the receiver, and printed droplets are intended to be placed in desired locations within each pixel, for example in the center of each pixel area, for simple printing schemes, or, alternatively, in multiple precise locations within each pixel area to achieve half-toning. If the placement of the droplets is incorrect and/or their placement cannot be controlled to achieve the placements desired within each pixel area, image artifacts may occur, particularly if similar types of deviations from desired locations repeat in adjacent pixel areas.

Incorrect placement of droplets may occur due to manufacturing variations between nozzles or to dirt or debris in or near some nozzles. Slight nozzle differences affect the trajectory direction of droplets ejected from a printhead, either in the direction in which the print head is scanned (fast scan direction) or in the direction in which the receiving medium is periodically stepped (slow scan direction, usually orthogonal to the fast scan direction). Slight errors in trajectory result in corresponding placement errors for printed drops. Another possible error source for dot placement is response time, which can be slightly different between nozzles in an array, resulting in displacement errors in the fast scan direction. That is, each nozzle in an array may not emit its dot of printing ink with precisely the same timing. As a result of such fabrication differences and timing response, dot positioning on the print medium may vary slightly, pixel to pixel, with respect to the desired positioning. For the most part, these minor differences result in error distances that are some fraction of a pixel dimension. For example, where pixels may be placed 30 microns apart, center-to-center, typical errors in dot placement are on the order of 2 microns or larger.

Under some conditions, small placement errors within this sub-pixel range of dimensions may be imperceptible in an output print. However, as is well known in the imaging arts, undesirable banding effects can be the result of a repeated pixel positioning error due to the printhead or its support mechanism. Such banding is typically most noticeable in areas of text or areas of generally uniform color, for example. Manufacturers of inkjet systems recognize that banding effects can severely compromise the image quality of output prints. One solution used to compensate for banding effects is the use of multiple banding passes, repeated over the same area of the printed medium. This enables a printhead to correct for known banding errors, but requires a more complex printing pattern and a more complex medium transport mechanism, and takes considerably more time per print. Under worst-case conditions, correction for band effects can result in significant loss of productivity, even as high as 10× by some estimates.

Even in the case that all nozzles have identical trajectory directions and identical timing responses, there may still be opportunity for improvement of image quality through the control of droplet placement within each pixel, for example to achieve half-toning or to improve the edge resolution of printed text.

It can readily be appreciated that it would be desirable to correct slight dimensional placement errors by controlling the operation of individual nozzles of print head 16, thus obviating the need for multiple banding passes. Proposed solutions for adjusting dot placement with ink jet printing apparatus of various types include the following:

U.S. Pat. No. 6,457,797 (Van Der Meijs et al.) discloses using timing changes to offset the effects of print head temperature changes on relative dot placement for a complete nozzle array in a drop-on-demand type ink jet printer;

U.S. Pat. No. 4,956,648 (Hongo) also discloses manipulating timing intervals for correcting slow and fast scan dot placement in a drop-on-demand type ink jet printer, segmenting the unit dot pitch time interval into suitable sub-intervals;

U.S. Pat. No. 6,536,873 (Lee et al.) discloses bidirectional droplet placement control in a drop-on-demand type ink jet printer, using heater elements in droplet formation;

U.S. Pat. No. 4,347,521 (Teumer) and U.S. Pat. No. 4,540,990 (Crean) discloses a print head employing a complex set of electrodes for droplet deflection in a continuous ink jet apparatus to account for variations in position and drop throw distance.

U.S. Pat. No. 4,533,925 (Tsao et al.) discloses a continuous inkjet printhead assembly in which drops are selectively charged to be deflected perpendicular to nozzle rows by particular amounts. By arranging the nozzle rows skewed with respect to the direction of movement of the medium, drops at any particular location in the printed image may be caused to originate from more than a single nozzle. Artifacts are thereby suppressed by choosing randomly amongst various nozzles.

U.S. Pat. No. 4,384,296 (Torpey) similarly discloses a continuous ink jet print head having a complex arrangement of electrodes about each individual print nozzle for providing multiple print droplets from each individual ink jet nozzle;

U.S. Pat. No. 6,367,909 (Lean) discloses a continuous ink jet printing apparatus employing an arrangement of counter electrodes within a printing drum for correcting drop placement;

U.S. Pat. No. 6,517,197 (Hawkins et al.) discloses an apparatus and method for corrective drop steering in the slow scan direction for a continuous ink jet apparatus using a droplet steering mechanism that employs a split heater element;

U.S. Pat. No. 6,491,362 (Jeanmaire) discloses an apparatus and method for varying print drop size in a continuous ink jet printer to allow a variable amount of droplet deflection in the fast scan direction with multiple droplets per pixel;

U.S. Pat. No. 6,213,595 (Anagnostopoulos et al.) discloses a continuous ink jet apparatus and method that provides ink filament steering at an angle offset from normal using segmented heaters;

U.S. Pat. No. 6,508,543 (Hawkins et al.) discloses a continuous ink jet print head capable of displacing printing droplets at a slight angular displacement relative to the length of the nozzle array, using a positive or negative air pressure;

U.S. Pat. No. 6,572,222 (Hawkins et al.) similarly discloses use of variable air pressure for deflecting groups of droplets to correct placement in the fast scan direction;

U.S. Patent Application No. 2003/0174190 (Jeanmaire) discloses improved measurement and fast scan correction for a continuous ink jet printer using air flow and variable droplet volume;

U.S. Pat. No. 6,575,566 (Jeanmaire et al.) discloses further adaptations for improved print droplet discrimination and placement using variable air flow for each ink jet stream; and U.S. Pat. No. 4,275,401 (Burnett et al.) discloses deflection of continuous ink jet print droplets in either the fast or slow scan direction using an arrangement of charging electrodes.

As the above listing shows, there have been numerous proposed solutions for correcting print droplet placement in both drop-on-demand and continuous inkjet printing apparatus. Not all of these solutions can be applied to a continuous ink jet printing apparatus, particularly for slight corrections for fast scan placement, for example for corrections in placement less than the center to center spacing of printed drops printed in succession, particularly where such an apparatus does not employ electrostatic forces for droplet deflection. Moreover, taken by themselves, none of these solutions meet all of the perceived requirements for robustness, precision accuracy to within a fraction of pixel dimensions, low cost, compatibility with slow scan adjustment mechanisms, and ease of application and adaptability. In particular, there remains significant room for improvement in implementation of droplet placement in the fast scan (F) direction, that is the direction in which a printhead is typically scanned rapidly across a recording medium. Specifically, there would be particular advantages to a solution that would allow the following:

(a) control of the number of droplets used to form a printed drop printed in a pixel;

(b) precision control of the center (centroid) of each printed drop printed within an associated pixel area, with respect to the fast scan direction; and, (c) control of the spread of each printed drop printed within an associated pixel area, with respect to the fast scan direction.

In addition, there remains room for improvement in controlling droplet placement in the slow scan direction, and for simple methods that allow control of drop placement in both orthogonal fast and slow scan directions. Prior art solutions which do not rely on complex means of steering drops in the slow scan direction, are unable to correct for placement errors of printed drops in both slow and fast scan directions and thus are unable to place drops at all desired locations within pixels.

SUMMARY OF THE INVENTION

According to a feature of the present invention, a method of printing includes associating a pixel area of a recording medium with a nozzle and a time interval during which a fluid drop ejected from the nozzle can impinge the pixel area of the recording medium; dividing the time interval into a plurality of subintervals; grouping some of the plurality of subintervals into blocks; associating one of two labels with each block, the first label defining a printing drop, the second label defining non-printing drops; associating no drop forming pulse between subintervals of each block having the first label; associating a drop forming pulse between each subinterval of each block having the second label; associating a drop forming pulse between other subintervals, the drop forming pulse being between each pair of consecutive blocks; and causing drops to be ejected from the nozzle based on the associated drop forming pulses.

According to another feature of the present invention, a method of printing includes associating a pixel area of a recording medium with a nozzle and a time interval during which a drop ejected from the nozzle can impinge the pixel area of the recording medium; dividing the time interval into a plurality of subintervals; grouping some of the plurality of subintervals into blocks; associating one of two labels with each block, the first label defining a printing drop, the second label defining non-printing drops; associating a drop forming pulse between consecutive selected subintervals of each block having the first label; associating a drop forming pulse between each subinterval of each block having the second label; associating a drop forming pulse between other subintervals, the drop forming pulse being between each pair of consecutive blocks; and causing drops to be ejected from the nozzle based on the associated drop forming pulses.

One advantage of the present invention that it provides a subdivided interval for droplet formation, allowing a number of flexible timing arrangements for droplet delivery from each individual inkjet nozzle and enabling a compact means of representing and controlling such timing arrangements. Another advantage of the present invention is that it provides precision printing droplet positioning in the fast scan direction. The present invention is also usable in conjunction with other printed drop positioning solutions, particularly those applicable to slow scan positioning. An additional advantage of the present invention is that it allows for at least a measure of correction for nozzle-to-nozzle differences in a continuous flow inkjet print head, providing adjustable positioning of droplets within sub-pixel dimensions. Another advantage of the present invention is that it allows the use of a variable number of printing droplets for forming each printed drop.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

Figure 1A:
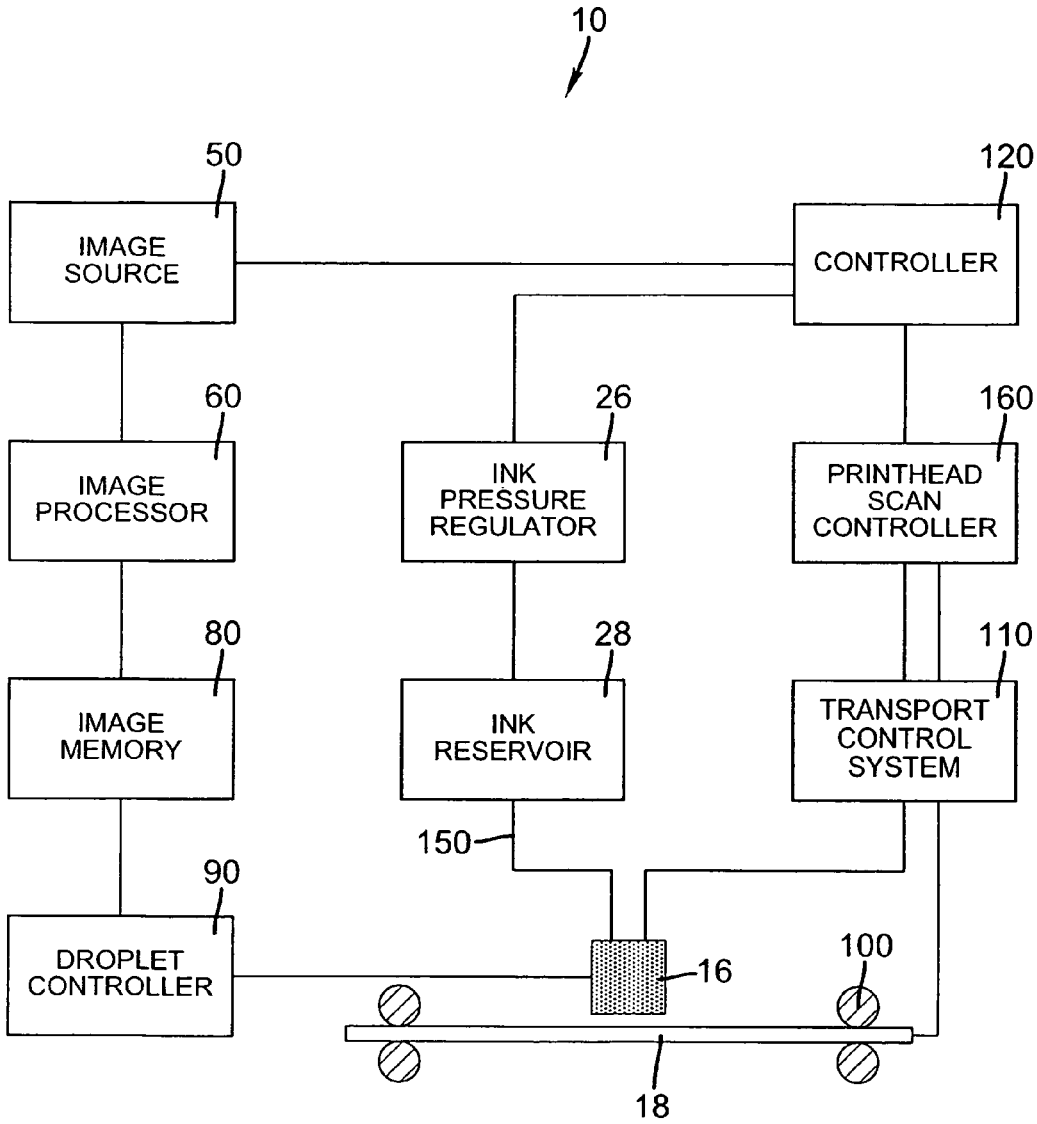
FIG. 1*a* shows a simplified block schematic diagram of one exemplary printing apparatus according to the present invention.
Figure 1B:
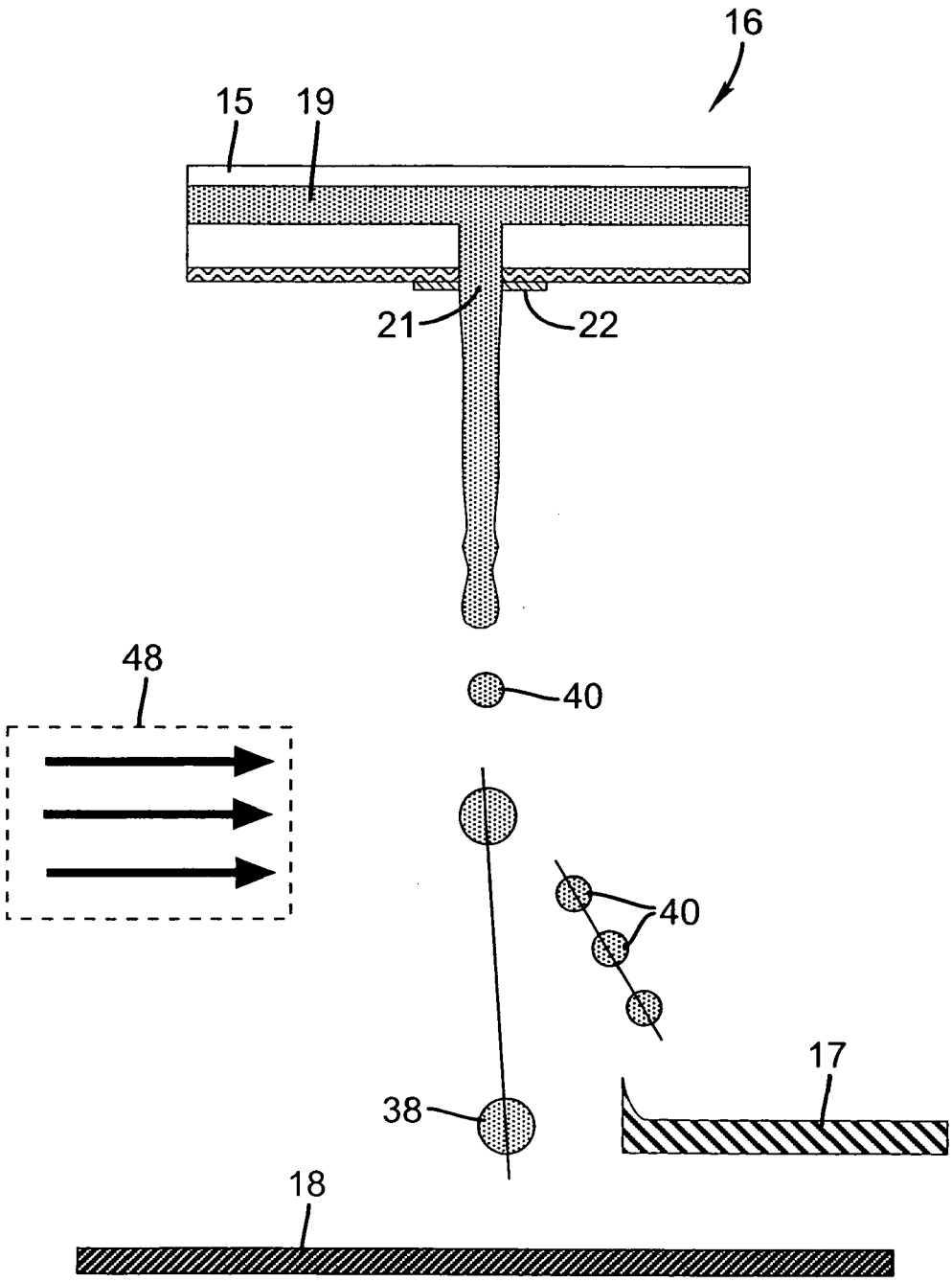
FIG. 1*b* shows a cross-section of a prior art printhead shown as part of FIG. 1*a;*

Referring to FIG. 1*a*-1*b,* there is shown an imaging apparatus 10 capable of controlling the trajectory of fluid droplets according to the present invention. Imaging apparatus 10 accepts image data from an image source 50 and processes this data for a print head 16 in an image processor 60. Image processor 60, typically a Raster Image Processor (RIP) or other type of processor, converts the image data to a pixel-mapped page image for printing. During printing operation, a recording medium 18 is moved relative to print head 16 by means of a plurality of transport rollers 100, which are electronically controlled by a transport control system 110. A logic controller 120 provides control signals for cooperation of transport control system 110 with an ink pressure regulator 26 and a printhead scan controller 160. Droplet controller 90 provides the drive signals for ejecting individual ink droplets from print head 16 to recording medium 18 according to the image data obtained from image memory 80. Image data may include raw image data, additional image data generated from image processing algorithms to improve the quality of printed images, and data for drop placement corrections, which can be generated from many sources, for example, from measurements of the steering errors of each nozzle 21 in printhead 16, as is well known to one skilled in the art of printhead characterization and image processing. Image memory 80 can therefore be viewed as a general source of data for drop ejection, such as the desired volume of ink drops to be printed, the exact location of printed drops, and shape of printed drops, as will we described.

Ink pressure regulator 26, if present, regulates pressure in an ink reservoir 28 that is connected to print head 16 by means of a conduit 150. It may be appreciated that different mechanical configurations for receiver transport control may be used. For example, in the case of page-width print heads, it is convenient to move recording medium 18 past a stationary print head 16. On the other hand, in the case of scanning-type printing systems, it is more convenient to move print head 16 along one axis (i.e., a sub-scanning direction) and recording medium 18 along an orthogonal axis (i.e., a main scanning direction), in relative raster motion.

For an understanding of the method of the present invention, it is important to observe that there is a close relationship between the timing of droplet formation and release at print head 16 (FIG. 1*a,* 1*b*) and the positional placement of that droplet to form a printed drop 32 (FIG. 2) on recording medium 18. This timing and related factors such as the volume of printing droplet 38 (FIG. 1*b*), deflective forces acting upon printing droplet 38 (FIG. 1*b*) when it is formed and during its flight time, speed of printing droplet 38, and distance between print head 16 and recording medium 18 all play a part in effecting the desired positioning of printing droplet 38 onto recording medium 18. The basic computations used for calculating the effects of each of these factors are relatively straightforward and are well known to those skilled in the inkjet printing arts.

It is also important to recognize that there is a close relationship between the signals provided to each nozzle of the printhead, for example signals in the form of voltage pulses carried on one or more wires connecting an image data source to the printhead or signals in the form of optical pulses carried by a fiber optic cable connecting the image data source to the printhead, and the timing of droplet formation and release at print head 16. The signals are typically represented as pulses in a timing diagram, as described later, and the timing diagram for signals arriving at a particular nozzle is thus closely related to the spatial pattern of droplets ejected from the nozzle and thus to the positional placement of the droplets on the recording medium.

Figure 2:
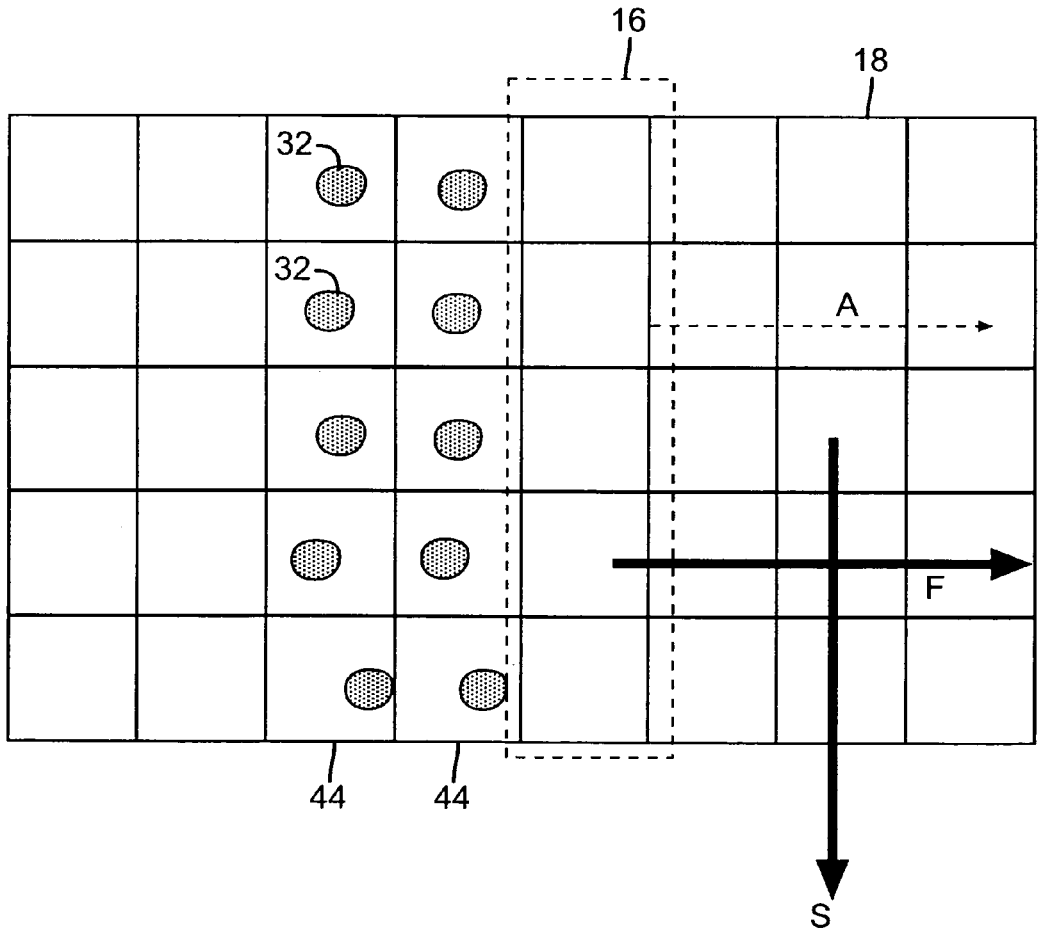
FIG. 2 is a plane view showing a portion of an array of printed droplets relative to the position and motion of the print head.

Referring to FIG. 2, there is shown a plane view of a small number of printed drops 32 printed by print head 16 within pixel areas 44 on recording medium 18. Ideally, in the example of FIG. 2, each printed drop 32 is centered within its corresponding pixel area 44. However, as is represented in FIG. 2, not all printed drops 32 in any sampling meet this ideal condition, due to manufacturing imperfections, for example. Of particular interest with respect to the present invention is printed drop 32 positioning with respect to fast scan direction F of print head 16. For reference, FIG. 2 also shows the directions of a deflecting air flow A (US Patent Application Publication No. 2003/0202054) and of slow scan S.

As is described in the above-cited disclosures of '595 Anagnostopoulos et al. and '362 Jeanmaire patents, printhead 16 provides a continuous stream of ink droplets. The continuous flow ink jet printer directs printing droplets to the surface of recording medium 18 and deflects non-printing droplets to a catcher, gutter, or similar device. The apparatus and method of the present invention uses the same basic droplet formation methods of these earlier patents, and also provides improved droplet timing techniques and improved techniques for quantifying image data in order to position and shape droplets with in pixel areas on a recording medium.

Figure 3A:
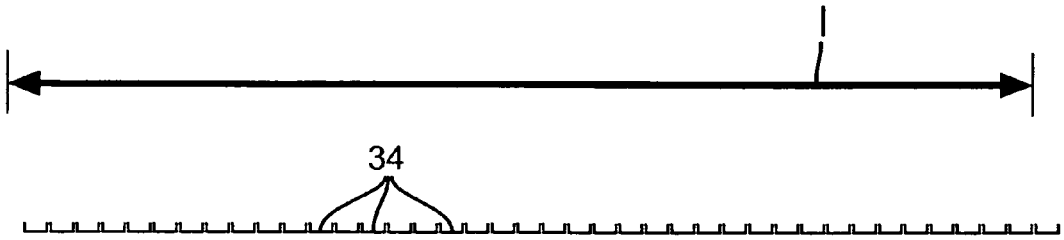
FIG. 3*a* is a timing diagram showing subdivision of time interval I into subinterval with an enlargement of the left portion of interval I for clarity.

Referring now to FIG. 3*a,* there is shown a timing diagram corresponding to a time interval I which has been divided into a plurality of subintervals 34, shown of equal duration in FIG. 3*a.* The enlargement of FIG. 3*a* is shown for clarity in depicting the subintervals 34. During a particular time interval I, drop forming pulses can be provided between adjacent subintervals 34. Such drop forming pulses are represented schematically in FIG. 3*b,* which illustrates the case of drop forming pulses placed between all adjacent subintervals. Certain patterns of drop forming pulses can cause printing drops to form at particular nozzles on printhead 16 of FIG. 1*a*-1*b,* as a result of the drop forming pulses being sent to printhead 16. Other patterns of drop forming pulses can cause non-printing drops to form at nozzles on printhead 16. Drop forming pulses are provided by droplet controller 90 of FIG. 1*a* and are typically voltage pulses sent to printhead 16 through electrical connectors, as is well known in the art of signal transmission. However, other types of pulses, such as optical pulses, may also be sent to printhead 16, to cause printing and non-printing droplets to be formed at particular nozzles, as is well known in inkjet printing. Once formed, printing drops travel through the air to a recording medium and later impinge on a particular pixel area of the recording medium which is thereby associated with interval I.

Figure 3B:
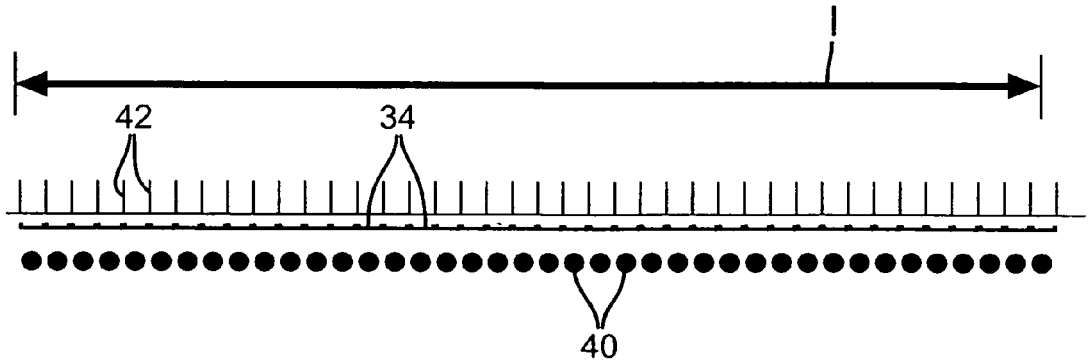
FIG. 3*b* is a timing diagram showing subdivision of time interval I into subintervals having drop forming pulses between adjacent subintervals resulting in a series of non-printing droplets (filled circles) traveling in air.

FIG. 3*b* shows the case in which drop forming pulses are placed between all adjacent subintervals in time interval I, which results in the formation of a series of non-printing droplets 40, represented by small filled circles in FIG. 3*b,* such non-printing droplets being ejected from a particular nozzle on printhead 16. Each non-printing droplet 40 in FIG. 3*b* can be said to have been produced by drop forming pulses at the beginning and end of the particular subinterval 34 shown above the non-printing droplet 40, the drop forming pulse at the beginning of the subinterval being a leading pulse for the subinterval 34 and a the drop forming pulse at the end of the subinterval 34 being a trailing pulse for subinterval 34. As described in U.S. Pat. Nos. 6,491,362 and 6,079,821, the non-printing droplet is formed some time after the leading and trailing pulses have been transmitted to printhead 16. Thus the small solid dots shown below the timing diagram of pulses in FIG. 3*b* are drawn to represent schematically the correspondingly formed ink droplets ejected from a particular nozzle and moving as a stream of drops through the air.

Printing droplets 38 and non-printing droplets 40 are formed as a result of drop forming pulses acting on the fluid column ejected from the printhead, as disclosed in the above-referenced '821 Chwalek et al. and '197 Hawkins et al. patents describing the formation of droplets at print head.

Figure 3C:
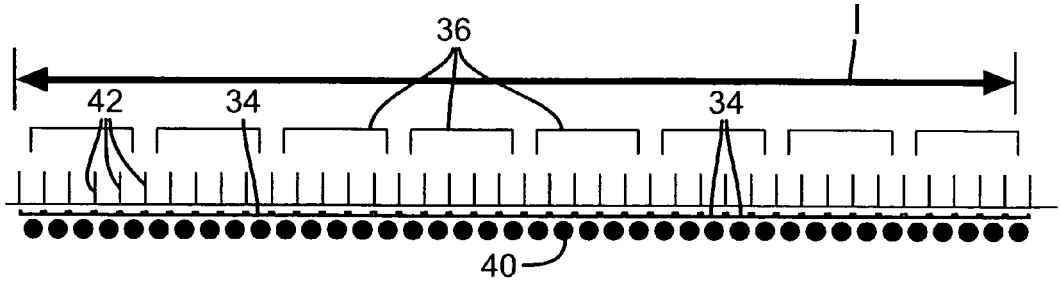
FIG. 3*c* is a timing diagram showing an arrangement of the subdivisions of FIG. 3*a,* grouped into blocks.

FIG. 3*c* illustrates the way imaging data from image memory 80 (FIG. 1) containing information on a printed drop desired to be printed on a particular pixel area 44 is used by droplet controller 90 (FIG. 1) to send patterns of drop forming pulses to printhead 16, whereupon any printing droplets once formed will travel through the air and impinge on a pixel area 44 corresponding to interval I on recording medium 18. Of course printing an image on a portion of recording medium 18 comprising many pixel areas requires many repetitions of this process over many time intervals and many nozzles, as is well known in the art of inkjet printing. Referring to FIG. 3*c,* there is represented a time interval I corresponding to the time available for forming a printed drop 32 comprising one or more printing droplets 38 (FIG. 2) ejected from a particular nozzle of printhead 16 in response to patterns of drop forming pulses 42 represented by vertical marks in interval I. In this case, there is a drop forming pulse 42 between all adjacent subintervals. Subintervals 34 in interval I are grouped into a plurality of blocks 36. In this particular case, each block 36 comprises five subintervals 34. For this example, then, interval I has a total of 40 subintervals 34, grouped in eight blocks 36. As is shown in FIG. 3*c,* each block 36 contains four pulses 42 and there is a single drop forming pulse labeled 43 between each block 36. The function of drop forming pulse labeled lying between blocks is described subsequently. In the case shown in FIG. 3*c* and all cases subsequently discussed, drop forming pulses 42 within blocks 36 and drop forming pulses 43 between blocks 36 occur between adjacent subintervals 34.

It is to be understood that although FIG. 3*a* and subsequent similar figures showing an interval I show blocks 36 beginning and ending within a subinterval 34 for clarity, it is within the spirit of the present invention that the time between the end of a block and the end of the last subinterval contained at least partially within the block can be arbitrarily small. Likewise, although the time between the end of one subinterval 34 and the beginning of the next is shown for clarity in FIGS. 3*a* and 3*b* as a substantial fraction of the subinterval, it can be arbitrarily small. Similarly, the time between blocks is shown for clarity to be about the same as the duration of a subinterval but can in fact be arbitrarily small.

The grouping of subintervals 34 into blocks 36 is employed in the present invention to efficiently use image data to produce desired drop printing pulse arrangements in interval I that result in one or more printing droplets 38 to be placed within a corresponding pixel area 44, corresponding, for example, to the a pixel of information a plurality of which generally comprise digital images. In FIG. 3*c,* the drop printing pulses 42 are present between all subintervals in all blocks and drop printing pulses 43 are present between all blocks. In this case, printhead 16, in response to drop printing pulses received typically as voltage pulses carried by connecting wires, produces a continuous series of non-printing droplets, as described in the above-referenced '821 Chwalek et al. and '197 Hawkins et al. patents describing the formation of droplets at print head.

Figure 4A:
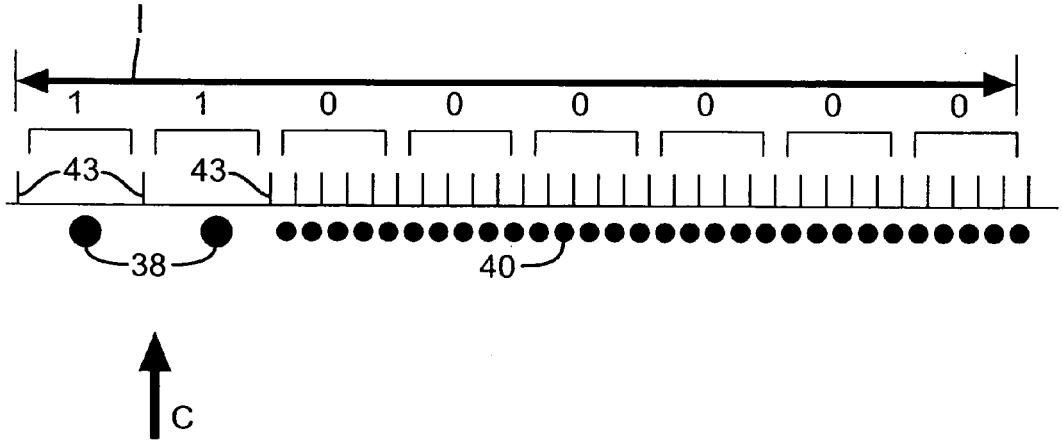
FIGS. 4*a*-4*e* are timing diagrams illustrating different arrangements of droplet formation where two printing droplets form a printed drop on a recording media.

Referring now to FIG. 4*a,* there is shown a timing diagram with a more complex droplet arrangement in interval I. This case differs from that of FIG. 3*c* in that the first two blocks 36 contain no drop forming pulses between subintervals lying entirely within each block. Here, two printing droplets 38 are formed early during interval I, followed by a succession of non-printing droplets 40, the mechanism of formation of the printing drops being described in the above-referenced '821 Chwalek et al. patent.

Figure 5A:
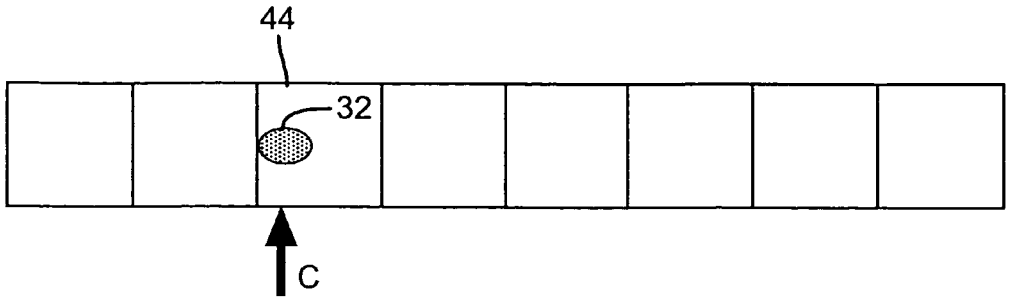
FIGS. 5*a*-5*e* are plane views showing printed drop formation corresponding to each of the example timing diagrams of FIGS. 4*a*-4*e;*

As the annotation of FIG. 4*a* indicates, blocks 36 that form printing droplets 38 are represented as a binary "1." Blocks 36 containing non-printing droplets 40 are represented as binary "0." Thus, the data string "11000000," a single 8-bit byte of data, could be used to represent the droplet arrangement of FIG. 4*a*. Referring to the corresponding printed drop placement diagram of FIG. 5*a,* there is shown the relative position of printed drop 32 within pixel area 44 for the droplet arrangement of FIG. 4*a,* comprising two printing droplets 38. When printed, printing droplets 38 tend to coalesce and form a single printed drop 32 having a centroid or spatial centroid C of ink density in the fast scan direction F (FIG. 2) on recording medium 18, as is well known in the art of inkjet printing. In terms of the timing diagram of FIG. 4*a,* timing centroid C corresponds to the time of pulse 43 between the first two blocks 36 of interval I. Centroid C may equivalently be viewed as corresponding to the spatial location midway between the two printing droplets 38 traveling through the air corresponding to the pattern of pulses in time interval I. As can be appreciated by one skilled in the art of ink droplet printing, knowing the timing centroid of printing drops, the velocity of the drops, and the location relative motion of the recording medium, and the way in which the ink and media interact, allow calculation of the spatial centroid of ink density on the recording medium. In the arrangement of FIG. 4*a,* drop forming pulses 43 act as leading and trailing drop forming pulses for printing droplets 38, indicated schematically by the solid dots in FIG. 4*a*. In other words, printing droplet 38 shown between two particular drop forming pulses 43 was formed as a result of those drop forming pulses acting on the fluid column ejected from the printhead, as disclosed in the above-referenced '821 Chwalek et al. In terms of the spatial positioning diagram of FIG. 5*a,* spatial centroid C is dependent upon the timing centroid C of FIG. 4*a,* allowing the position of spatial centroid C to be adjusted by manipulating this timing arrangement of printing droplet 38 formation. Spatial centroids C of printed drops 32 can thereby be flexibly and accurately moved in direction F of FIG. 2.

Figure 4B:
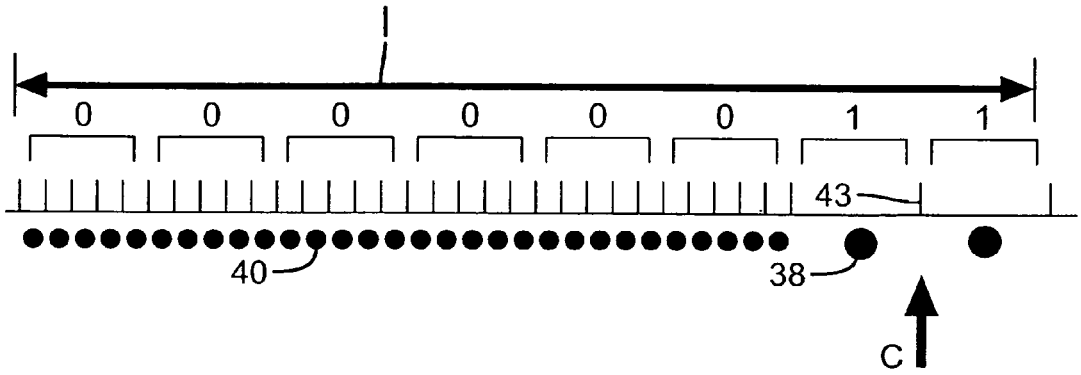
Figure 4C:
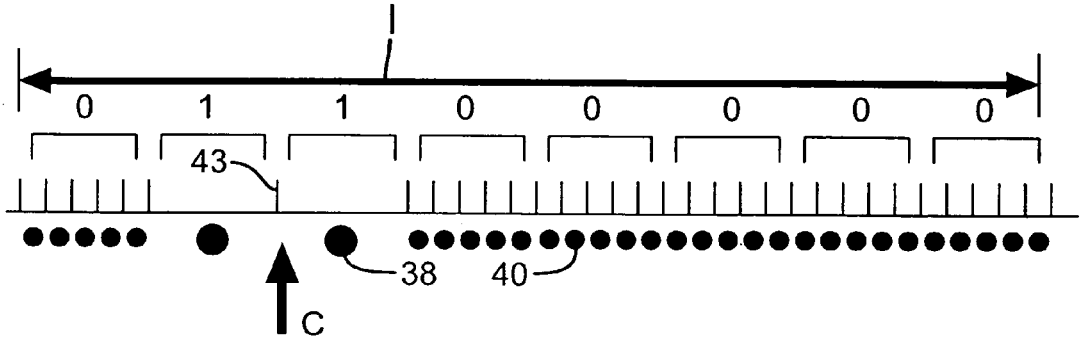

FIGS. 4*b* and 4*c* and their corresponding printed drop placement diagrams 5*b* and 5*c* show other alternate arrangements of two printing droplets 38 within interval I and show how this timing impacts their relative placement in forming printed drop 32. As with FIGS. 4*a* and 5*a,* centroid C is also indicated. Binary data strings also differ between these sequences, as shown. Spatial centroid C of the printed drops 32 is seen to be moved in its associated pixel area in the direction F of FIG. 2 in FIGS. 4*b* and 4*c* compared to its position FIG. 4*a,* in accordance with the binary representation of 1's and 0's in FIGS. 4*a*-4*c,* due to the fact that the blocks 36 corresponding to printing droplets 38 occur at different times and to the fact that the receiving medium moves relative to the print head in direction F. The binary representations for FIGS. 4*b* and 4*c* are the data strings "00000011," and "01100000,"

Figure 4D:
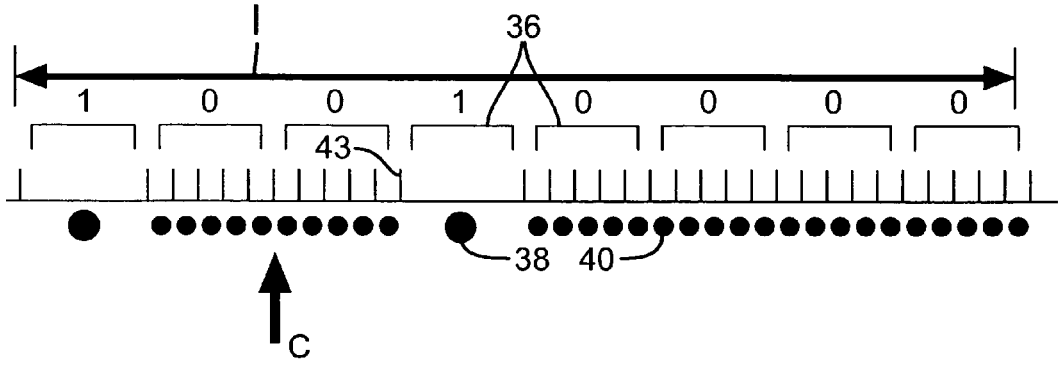
Figure 4E:
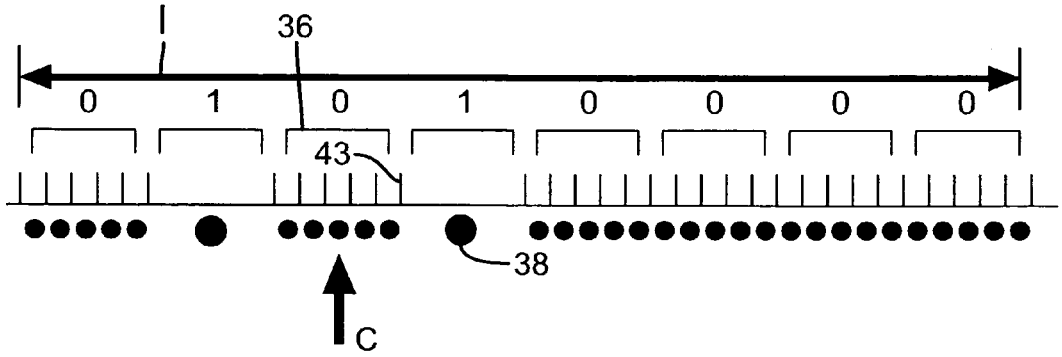
Figure 5B:
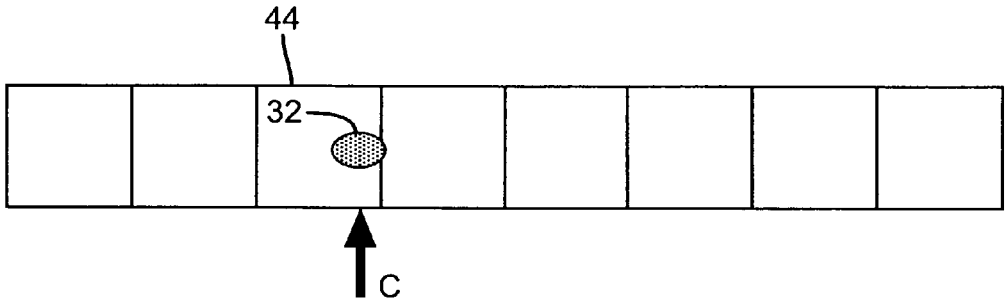
Figure 5C:
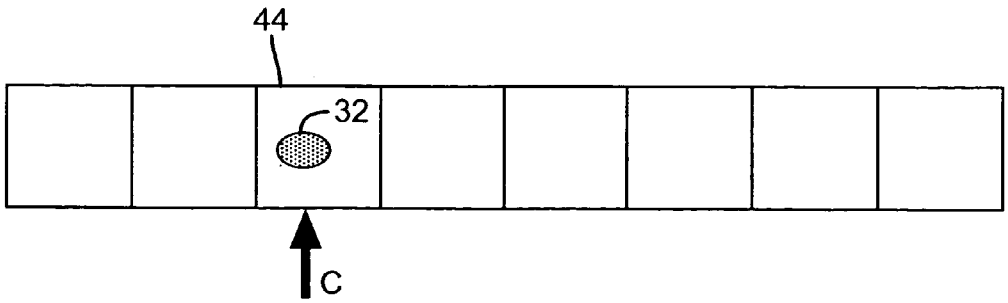
Figure 5D:
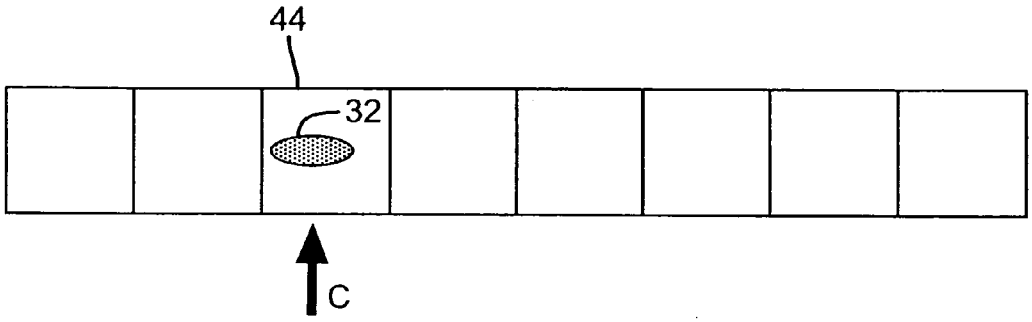
Figure 5E:
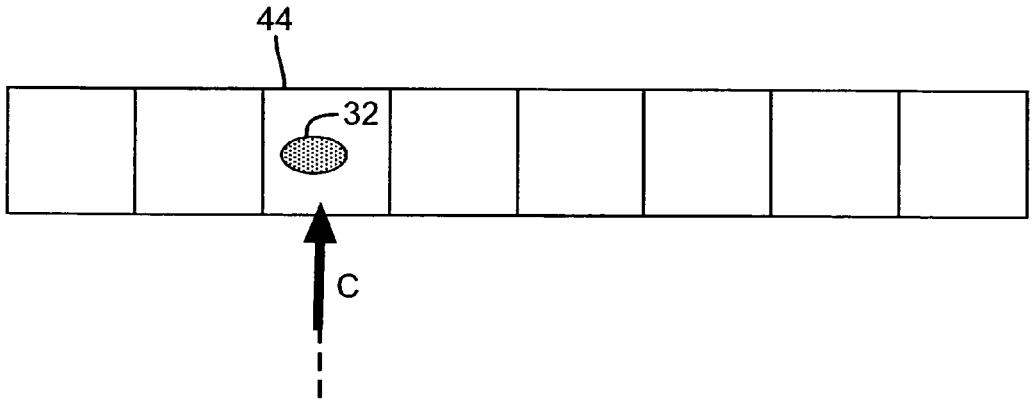

FIGS. 4*d* and 4*e* and their corresponding printed drop placement diagrams 5*d* and 5*e* show yet other alternate arrangements using two printing droplets 38 within interval I. The binary representations for FIGS. 4*d* and 4*e* are the data strings "10010000," and "01010000." As these examples show, printing droplets 38 may be separated by one or more blocks 36 of non-printing droplets 40. As FIGS. 5*d* and 5*e* show, the resulting printed drops 32 are elongated relative to the earlier examples of FIGS. 5*a*-5*c,* where only a single drop forming pulse 43 is provided between printing droplets 38. This is due to the fact that printing droplets 38 are more widely separated in time in FIGS. 4*d* and 4*e* compared with FIGS. 4*b* an 4*c* and to the fact that the receiving medium moves relative to the print head. Centroid C placement is still halfway between printing droplets 38.

Figure 6A:
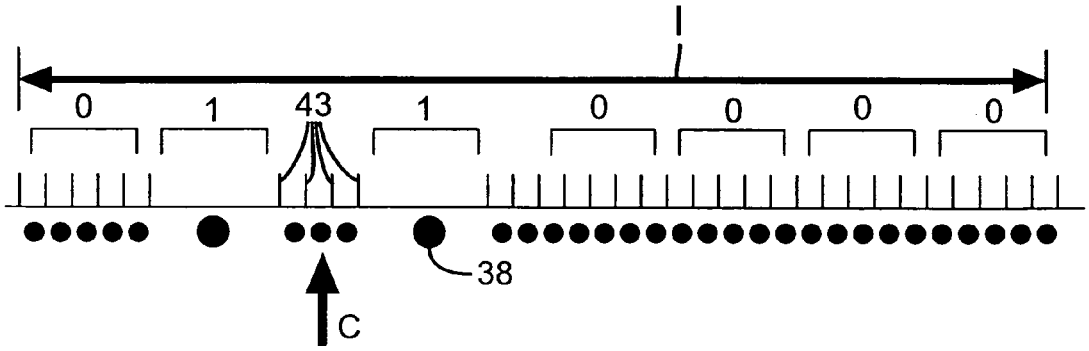
FIG. 6*a* is a timing diagram showing an alternate arrangement used for droplet formation with modified timing.
Figure 6B:
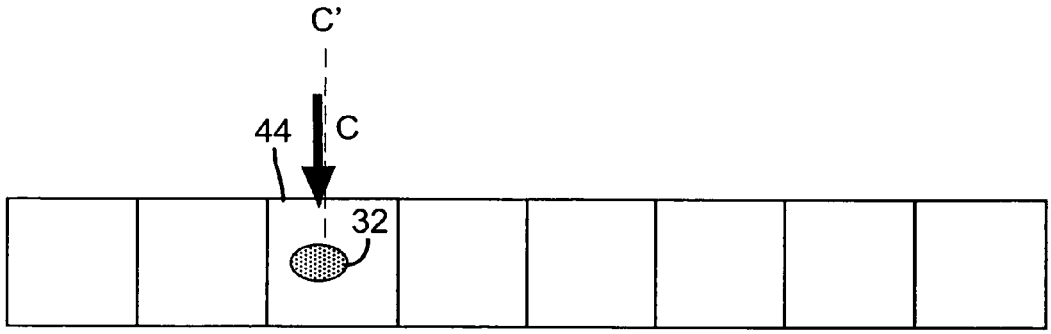
FIG. 6*b* is a plane view showing printed drop formation corresponding to the timing diagram of FIG. 6*a;*

In the examples of FIGS. 4*a*-4*e,* each block 36 is maintained as a unit, exclusively either forming a printing droplet 38 or forming a series of non-printing droplets 40. Either a single drop forming pulse 43 or one or more blocks 36 of non-printing droplets 40 separate two printing pulses 38. However, this arrangement allows variation, as is shown in the examples of FIGS. 6*a* and 6*b*. Here, the symmetric 8-bit arrangement for each block 36 is not used; instead, the number of complete blocks 36 is reduced and three non-printing droplets 40 are provided between the two printing droplets 38. Here drop forming pulses 43 between blocks are used between printing droplets 38, the sequence being represented, for example, as "01-310000," the "–3" representing the addition of 3 additional pulses 43 between blocks. As is shown most clearly by comparing FIGS. 5*e* and 6*b,* a slight shifting of centroid C of printed drop 32 results. FIG. 6*b* compares the position of centroid C from the timing arrangement of FIG. 6*a* with the slightly different position of centroid C' from FIGS. 4*e* and 5*e*. This slight shifting depends on the number of drop forming pulses 43 and pulses 42 between blocks 36 corresponding to printing droplets 38 and can be varied by small amounts by changing the number of drop forming pulses 43 and pulses 42 between blocks 36. Similarly, the printed drop 32 is slightly elongated depending on the number of drop forming pulses 43 and pulses 42 between blocks 36. Thus, it can be seen that this type of altered timing pattern allows numerous possible arrangements for shifting the position of printed drop 32 accurately within printed drop area 44 and for shaping printed drop 32 more precisely which can be simply represented. While the sequence "01-310000" can be used to represent the pattern of drop forming pulses in FIG. 6*a,* other representations are of course also possible, as is well know in the art of digital imaging. Thus the data stored in image memory 80 (FIG. 1) can be stored in a simple and compact way for transmittal to droplet controller 90 (FIG. 1). Simple representations of image data reduce the complexity and cost of data storage and transmission in printing systems and simplify image processing. In this way, changing the number of printing droplets 38 and the relative spacing between them during interval I allows controllable adjustment of printed drop 32 position to within a fraction of printed drop area 44 dimensions. This fraction is smaller than that which could have been achieved only by interchanging blocks 36 producing to printing ("1") droplets 38 and non-printing ("0") droplets 40.

In the examples given thus far, printed drop 32 has been formed from two printing droplets 38. However, the method described hereinabove can be applied for any number of printing droplets 38 that can be accommodated, given the number of subintervals 34 available within interval I (FIG. 3*c*) and the number of subintervals 34 needed in order to properly form printing droplet 38. As a rule of thumb, at least four subintervals 34 would be used to form printing droplet 38, as disclosed in the above-referenced '821 Chwalek et al. At a minimum, the method of the present invention could be used for an interval I containing a single printing droplet 38; however, the use of multiple printing droplets 38 to form printed drop 32 is advantaged, as will be readily appreciated to those skilled in the digital imaging arts.

Figure 7A:
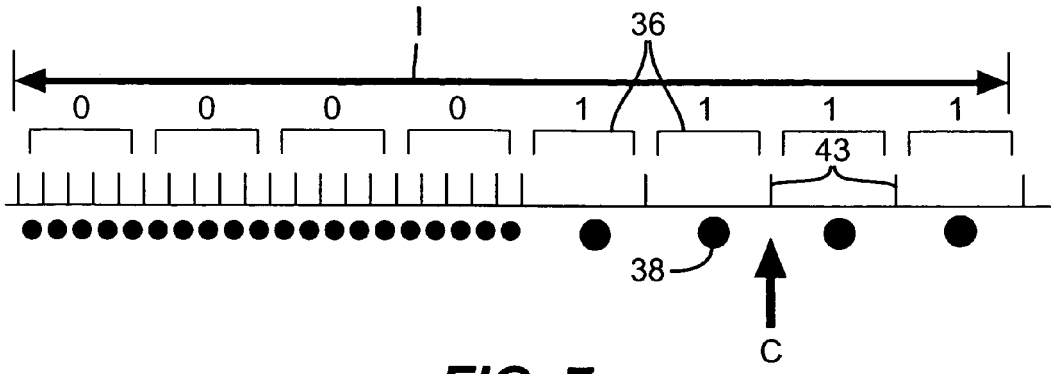
FIGS. 7*a*-7*c* are timing diagrams illustrating different arrangements of droplet formation where 4 droplets form a printed drop.
Figure 7B:
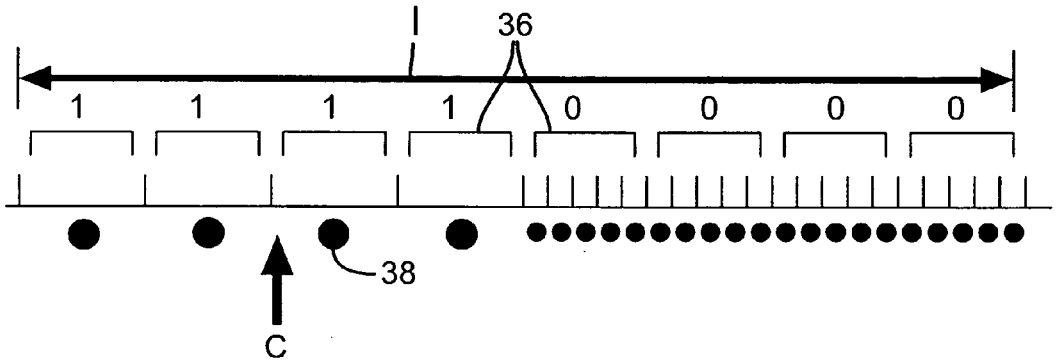
Figure 7C:
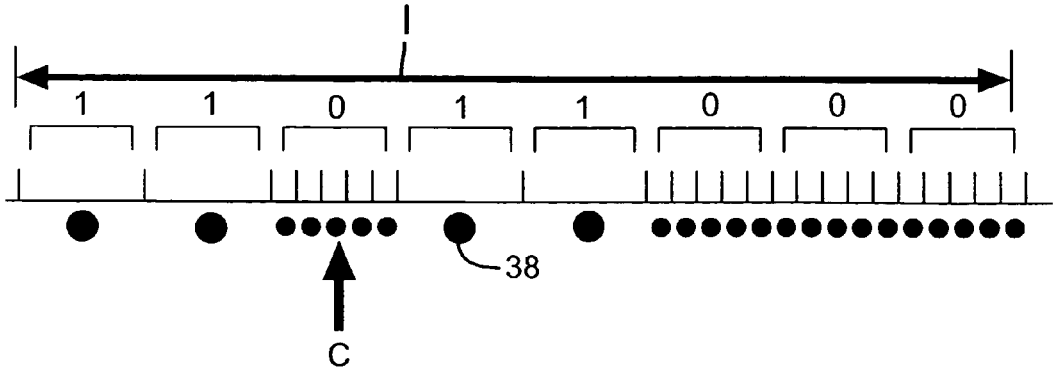
Figure 8:
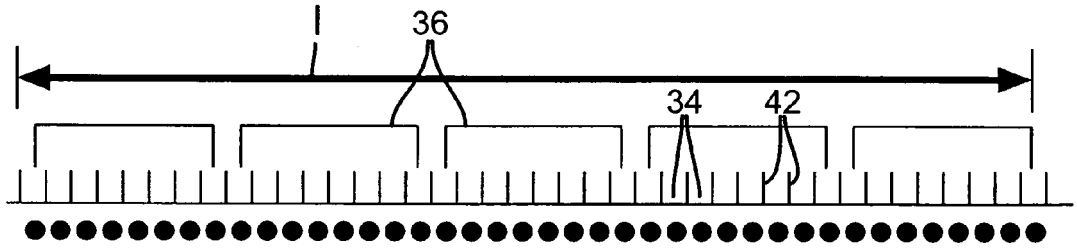
FIG. 8 is a timing diagram showing an arrangement of the subdivisions of FIG. 3*a,* grouped into blocks of an alternate size, each block being of a type producing only non-printing droplets.
Figure 9A:
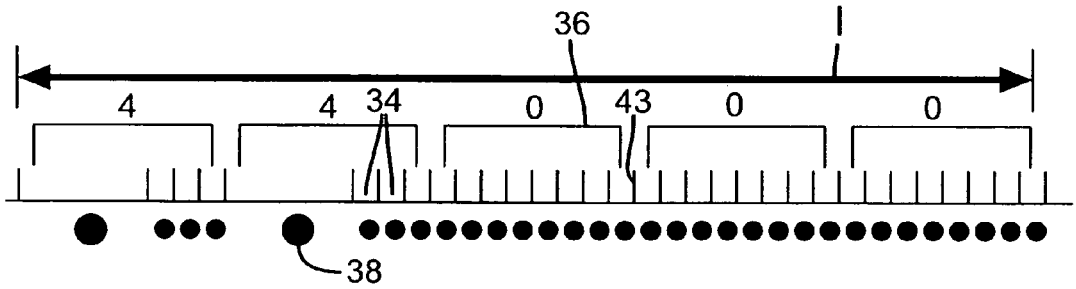
FIGS. 9*a*-9*d* are timing diagrams illustrating different arrangements of droplet formation where two droplets form a printed drop.
Figure 9B:
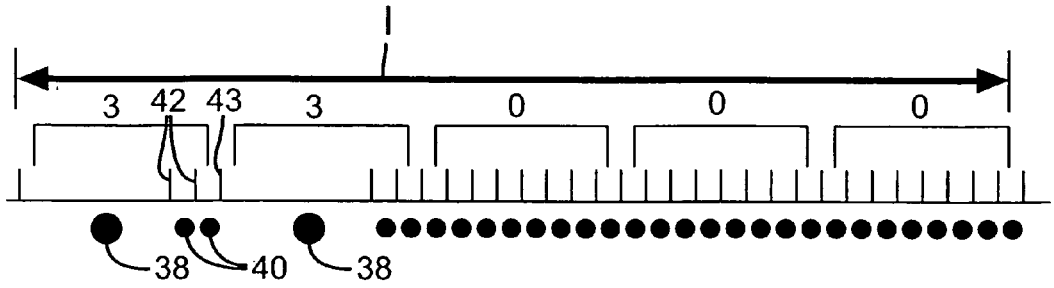
Figure 9C:
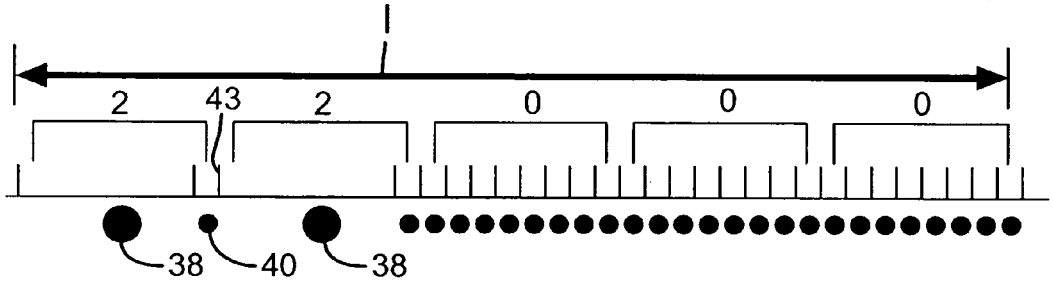
Figure 9D:
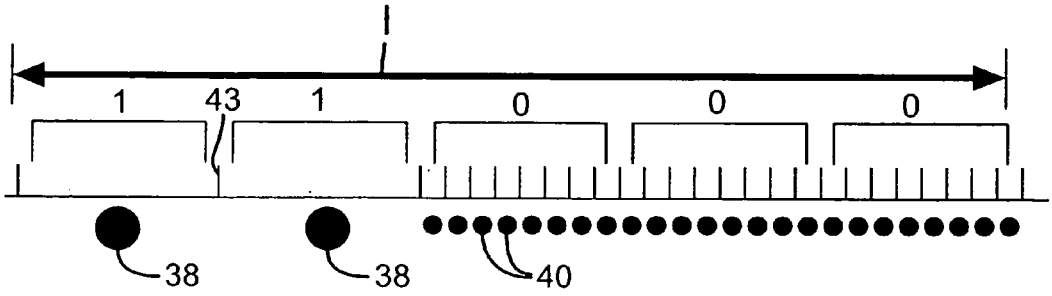
Figure 10A:
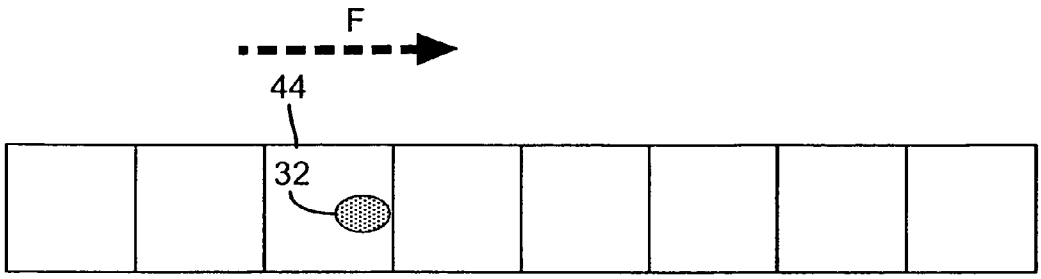
FIGS. 10*a*-10*d* are plane views showing printed drop formation corresponding to each of the example timing diagrams of FIGS. 9*a*-9*d.*
Figure 10B:
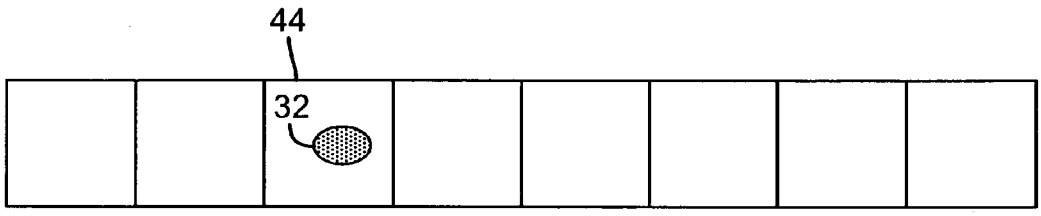
Figure 10C:
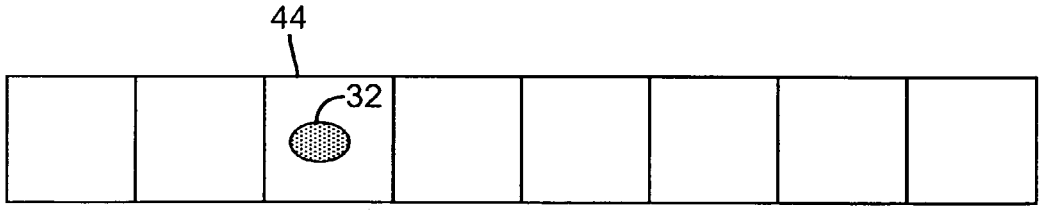
Figure 10D:
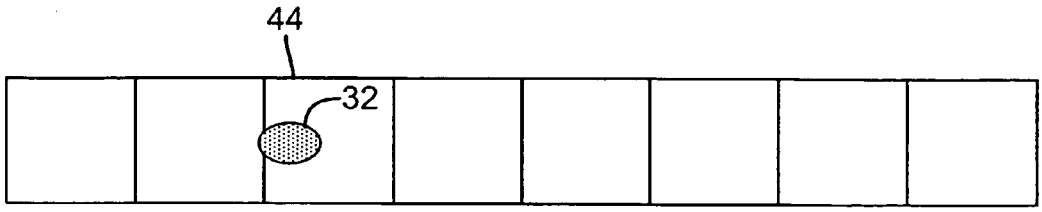

As another example, FIGS. 7*a,* 7*b,* and 7*c* show the use of four printing droplets 38 within interval I. The same digital logic convention for blocks 36 could be applied where it is appropriate. Again, timing and spatial centroids C would be flexibly and accurately moved in direction F of FIG. 2 according to the configuration employed, using this timing scheme. The representation of the pulse sequence of FIG. 7*a* is "00001111," although many representations of such printing data, included data compression, are well known. In FIGS. 7*b*-7*d,* the representations of the pulse sequences is indicated by the numbers above the blocks 36. While grouping to allow representation by a byte of digital data has advantages, the method of the present invention allows grouping in any other useful arrangement. Referring now to FIG. 8, there is shown an alternate arrangement in which each block 36 consists of eight subintervals 34. This type of alternate arrangement also provides added flexibility, explained below, for controlling the size (ink volume) of printing droplets 38 and for the position of printed drops 32 within their associated pixel area in direction F of FIG. 2. As is described in the above-cited Jeanmaire et al. '566 patent, changing the volume of printing droplet 38 affects not only the relative size of printed drop 32 formed on recording medium 18, it also affects the in-flight trajectory of printing droplet 38 as it is ejected toward recording medium 18. Droplets 38 having greater volume are not as easily deflected by air flow or electrostatic deflection means. The direction of airflow is shown as direction A relative to printhead 16 in FIG. 2, usually orthogonal to the line of nozzles of printhead 16, as described in the above-cited Jeanmaire et al. '566 patent. Typically the direction A of deflecting air flow is parallel to fast scan direction F. Referring to FIG. 9*a,* there is shown an example in which printing droplet 38 is formed over five subintervals 34. In FIG. 9*b,* printing droplet 38 is formed over six subintervals 34 in the sense that six adjacent subintervals have no drop formation pulse between blocks. In FIGS. 9*c* and 9*d,* printing droplet 38 is formed over seven and eight subintervals 34, respectively. As is well known, droplet volume is a factor of nozzle size, ink velocity, and pulse 42, 43 timing. Typical volumes for non-printing droplets 40 might be in the 4-5 picoliter range, for example. In such a case, each added subinterval 34 would increase the volume of printing droplet 38 by that amount. Again in these examples, data transmitted from image memory 80 (Fig.) to droplet controller 90 (FIG. 1) can be represented by simple numerical strings. For example, the sequence "44000," "33000," "22000," "11000" could be used to represent the pattern of drop forming pulses in FIG. 9*a*-9*d,* respectively, the repeated numbers "44" "33," and "22". indicating the occurrence of multiple drop forming pulses 42 and 43 which cause printed drop 38 to be reduced in volume from its largest volume (FIG. 9*d*) by an amount equal to the volume of two non-printing drops. Other representations are of course also possible, as is well know in the art of digital imaging. Simple representations of image data reduce the complexity and cost of data storage and transmission in printing systems and simplify image processing.

FIGS. 10*a*-10*d* show the corresponding spatial positioning and comparative shape of printed drops 32 when using the timing sequences of FIGS. 9*a*-9*d,* respectively. Both centroid C and the volume of printing droplets 38 vary between FIGS. 9*a*-9*d,* causing the corresponding changes in spatial position shown in FIGS. 10*a*-10*d.*

The timing method of the present invention allows control of an individual ink jet nozzle in print head 16. This method can be applied separately to each individual nozzle when print head 16 comprises an array of nozzles. Thus, slight differences in performance, nozzle-to-nozzle, can be corrected using the method of the present invention. This allows the use of the method of the present invention to be used after a calibration sequence is performed on print head 16. By way of illustration, observe that conventional calibration practice would follow these basic steps for each nozzle:

(i) release printing droplet 38 onto a calibration print with a standard, predetermined timing;

(ii) measure the error between the ideal and actual positioning of printing droplet 38 for this nozzle, based on this standard timing; and, (iii) calculate and store a calibration correction factor that adjusts nozzle timing for each nozzle to correct for any measured error.

Then, when printing using this nozzle, the calculated calibration correction factor is applied accordingly for the printing of all images. Such a calibration correction factor would typically be stored in a Look-Up Table, as is familiar to those skilled in the imaging arts.

Additionally, following calibration using the calibration procedure above, the image quality of images other than the calibration print, for example images containing text or photoquality pictures, can be improved by including, for each printed drop, the steps of (iv) calculating, for each pixel area in that image, an additional image dependent drop position and shape correction factor, for example by using any of many well known image processing algorithms designed to hide image artifacts in pictures and/or to smooth the edges of printed text, (v) using the additional image dependent drop position correction factors and drop shape correction factors to additionally adjust droplet timing for droplets printed at each pixel area in order that corrections be made not only to correct for misdirection or timing variations of individual nozzles but also to improve image quality by incorporating image processing algorithms.

The invention has been described in detail with particular reference to certain preferred embodiments thereof, but it will be understood that variations and modifications can be effected within the spirit and scope of the invention.

PARTS LIST

10. Printer system
14. Heater control circuits
15. Substrate
16. Printhead
17. Ink gutter
18. Recording medium
19. Ink
20. Medium transport system

21. Nozzles
22. Heater
24. Micro controller
26. Ink pressure regulator
28. Reservoir
30. Ink channel
32. Printed drop
34. Subinterval
36. Block
38. Printing droplet
40. Non-printing droplet
42. Pulse
43. Drop forming pulse
44. Pixel areas
48. Deflection means
50. Image source
60. Image processor
80. Image memory
90. Droplet controller
100. Recording medium transport roller
110. Transport control system
120. Logic controller
150. Ink conduit
160. Printhead scan controller
A. Deflecting air flow
C. Centroid
I. Printed drop interval
F. Fast scan direction
S. Slow scan direction

The invention claimed is:

1. A method of printing comprising:

associating a single pixel area of a recording medium with a nozzle and with a time interval during which a fluid drop ejected from the nozzle can impinge the corresponding single pixel area of the recording medium;

dividing the time interval into a plurality of subintervals;

grouping some of the plurality of subintervals into blocks;

associating one of two labels with each block, the first label defining a printing drop, the second label defining non-printing drops;

associating no drop forming pulse between subintervals of each block having the first label;

associating a drop forming pulse between each subinterval of each block having the second label;

associating a drop forming pulse between other subintervals not grouped into a block, the drop forming pulse being between each pair of consecutive blocks; and causing drops to be ejected from the nozzle based on the associated drop forming pulses.

2. The method according to claim 1, wherein each subinterval is of the same duration.

3. The method according to claim 1, wherein each block includes the same number of subintervals.

4. The method according to claim 1, wherein no subinterval is completely positioned between successive blocks.

5. The method according to claim 1, a printed drop comprising an integral number of printing drops of equal volume, the method further comprising:

obtaining a desired fluid volume of the printed drop located within the single pixel area from print data; and associating the first label with a number of blocks of the time interval and associating the second label with any remaining blocks of the time interval such that the volume of the printed drop substantially equals the desired fluid volume of the printed drop.

6. The method according to claim 5, wherein the number of blocks associated with the first label comprises no blocks.

7. The method according to claim 5, wherein the number of blocks associated with the first label comprises one block.

8. The method according to claim 7, further comprising:

obtaining a location of the printed drop located within the single pixel area from print data; and ordering the block associated with the first label and any remaining blocks associated with the second label based on the location of the printed drop.

9. The method according to claim 5, wherein the number of blocks associated with the first label comprises a plurality of blocks.

10. The method according to claim 9, wherein the plurality of blocks associated with the first label are consecutive.

11. The method according to claim 10, further comprising:

obtaining a location of the printed drop located within the single pixel area from print data; and ordering the plurality of blocks associated with the first label and any remaining blocks associated with the second label based on the location of the printed drop.

12. The method according to claim 9, further comprising:

obtaining a shape of the printed drop located within the single pixel area from print data; and ordering the plurality of blocks associated with the first label such that one block associated with the first label is spaced apart from another block associated with the first label by at least one block associated with the second label.

13. The method according to claim 12, further comprising:

ordering the plurality of blocks associated with the first label such that one block associated with the first label is spaced apart from another block associated with the first label by additional drop forming pulses associated between other subintervals.

14. The method according to claim 9, further comprising:

obtaining a shape of the printed drop located within the single pixel area from print data; and ordering the plurality of blocks associated with the first label such that one block associated with the first label is spaced apart from another block associated with the first label by additional drop forming pulses associated between other subintervals.

15. A method of printing comprising:

associating a pixel area of a recording medium with a nozzle and a time interval during which a fluid drop ejected from the nozzle can impinge the pixel area of the recording medium;

dividing the time interval into a plurality of subintervals, all subintervals being equal in duration;

grouping some of the plurality of subintervals into blocks;

associating one of two labels with each block, the first label defining a printing drop, the second label defining non-printing drops;

associating no drop forming pulse between subintervals of each block having the first label;

associating a drop forming pulse between each subinterval of each block having the second label;

associating a drop forming pulse between other subintervals not grouped into a block, the drop forming pulse being between each pair of consecutive blocks; and causing drops to be ejected from the nozzle based on the associated drop forming pulses.

16. A method of printing comprising:

associating a pixel area of a recording medium with a nozzle and a time interval during which a fluid drop ejected from the nozzle can impinge the pixel area of the recording medium;

dividing the time interval into a plurality of subintervals;

grouping some of the plurality of subintervals into blocks;

associating one of two labels with each block, the first label defining a printing drop, the second label defining non-printing drops;

associating no drop forming pulse between subintervals of each block having the first label;

associating a drop forming pulse between each subinterval of each block having the second label;

associating a drop forming pulse between other subintervals not grouped into a block, the drop forming pulse being between a pair of consecutive blocks spaced apart from each other over the time interval; and causing drops to be ejected from the nozzle based on the associated drop forming pulses.

* * * * *